US009224313B2

(12) United States Patent
Reibke et al.

(10) Patent No.: US 9,224,313 B2
(45) Date of Patent: Dec. 29, 2015

(54) MARKING DEVICE FOR SWITCHGEAR CABINETS AND OTHER ELECTRICAL EQUIPMENT

(71) Applicant: PHOENIX CONTACT GMBH & CO. KG, Blomberg (DE)

(72) Inventors: Heinz Reibke, Bad Salzuflen (DE); Thomas Poelker, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 14/391,168

(22) PCT Filed: Apr. 8, 2013

(86) PCT No.: PCT/EP2013/001029

§ 371 (c)(1),
(2) Date: Oct. 8, 2014

(87) PCT Pub. No.: WO2013/152844

PCT Pub. Date: Oct. 17, 2013

(65) Prior Publication Data

US 2015/0068085 A1 Mar. 12, 2015

(30) Foreign Application Priority Data

Apr. 10, 2012 (DE) ..... 10 2012 007 004

(51) Int. Cl.

| | |
|---|---|
| ***G09F 3/18*** | (2006.01) |
| ***G09F 3/16*** | (2006.01) |
| ***G09F 3/20*** | (2006.01) |

(52) U.S. Cl.

CPC .. *G09F 3/16* (2013.01); *G09F 3/18* (2013.01); *G09F 3/204* (2013.01)

(58) Field of Classification Search

CPC ..... G09F 3/204
USPC ..... 40/642.02, 611.06, 611.08, 585, 40/661.03; 24/460, 462; 52/317, 844

See application file for complete search history.

(56) References Cited

U.S. PATENT DOCUMENTS

| | | | | |
|---|---|---|---|---|
| 3,969,838 | A * | 7/1976 | Moore | 40/611.06 |
| 4,753,026 | A * | 6/1988 | Woodman et al. | 40/584 |
| 7,975,413 | B1 * | 7/2011 | Baryla, Sr. | 40/611.08 |

FOREIGN PATENT DOCUMENTS

| | | | |
|---|---|---|---|
| DE | 19847540 | A1 | 4/2000 |
| DE | 202009003250 | U1 | 7/2010 |
| JP | 60112278 | U | 7/1985 |

OTHER PUBLICATIONS

International Search Report of PCT/EP2013/001029, Oct. 10, 2013.

* cited by examiner

*Primary Examiner* — Joanne Silbermann
(74) *Attorney, Agent, or Firm* — Leydig, Voit & Mayer, Ltd.

(57) ABSTRACT

An identification device for switch cabinets and other electrical devices includes at least one identification plate and a carrier profile configured to receive the identification plate. The carrier profile further includes a rear wall, a first and second lateral holding wall, and at least one support web. The first and second lateral holding walls extend forwards from the rear wall. The support web extends traversely to at least one holding wall and is configured to support the identification plate. At least one misplacement guard is provided and is configured to prevent the identification plate from being placed below the support web when mounted.

14 Claims, 3 Drawing Sheets

MARKING DEVICE FOR SWITCHGEAR CABINETS AND OTHER ELECTRICAL EQUIPMENT

CROSS-REFERENCE TO RELATED APPLICATIONS

This application is a U.S. National Phase application under 35 U.S.C. §371 of International Application No. PCT/EP2013/001029, filed on Apr. 8, 2013, and claims benefit to German Patent Application No. DE 10 2012 007 004.7, filed on Apr. 10, 2012. The International Application was published in German on Oct. 17, 2013 as WO 2013/152844 A2 under PCT Article 21 (2).

FIELD

The present invention relates to an identification device for switch cabinets and other electrical devices and for the system construction.

BACKGROUND

A wide range of identification devices for switch cabinets for attaching identification plates to switch cabinets for the purpose of precise identification have become known in the prior art. A drawback of the known identification devices is that the identification plates generally have to have precisely defined dimensions, since the bearing and supporting surfaces are tailored exactly to the identification plates provided in each case. It is also possible with the known identification devices for the identification plates to be incorrectly inserted in a crooked manner when being mounted, if, for example, one side of an identification plate is mistakenly pushed below the provided supporting surface when mounted. Mounting then has to be repeated or, if incorrect mounting goes unnoticed, there is the risk of losing said plate.

SUMMARY

In an embodiment, the present invention provides an identification device for switch cabinets and other electrical devices including at least one identification plate and a carrier profile configured to receive the identification plate. The carrier profile further includes a rear wall, a first and second lateral holding wall, and a support web. The first and second lateral holding walls extend forwards from the rear wall. The support web extends traversely to at least one of the lateral holding walls and is configured to support the identification plate. A misplacement guard is provided and is configured to prevent the identification plate from being placed below the support web when mounted.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
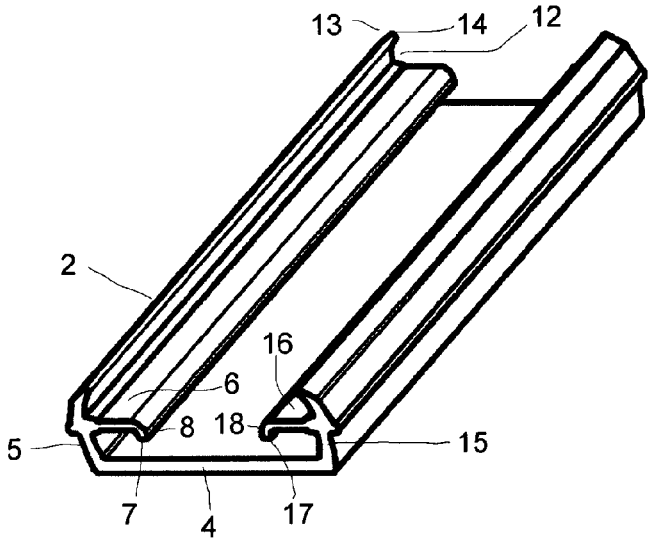
FIG. 1 is a perspective view of a carrier profile of an identification device according to the invention.

An aspect of the invention provides an identification device for switch cabinets and other electrical devices which simplifies mounting and with which incorrect placement of an identification plate can be more easily avoided.

In an embodiment, the invention provides an identification device for switch cabinets and other electrical devices having the features of claim 1 and by an identification device for switch cabinets and other electrical devices having the features of claim 13. Preferred developments of the invention are the subject matter of the dependent claims. Further advantages and features of the present invention are found in the general description and in the description of the embodiments.

An identification device, according to an embodiment of the invention, for switch cabinets and other electrical devices has at least one carrier profile and at least one identification plate. In this device, the carrier profile is suitable and designed for receiving the identification plate. The carrier profile comprises a rear wall and two lateral holding walls extending forwards from the rear wall. At least one support web is provided on the carrier profile, is intended to support the identification plate and extends transversely to at least one holding wall. At least one misplacement guard is provided to prevent the identification plate from being placed below the support web when being mounted.

The identification device according to an embodiment of the invention has many advantages. One significant advantage of the identification device according to an embodiment of the invention is ensured by the misplacement guard. This allows incorrect placement of an identification plate during mounting to be reliably prevented. The misplacement guard significantly reduces errors during mounting.

Owing to the invention, mounting is made significantly easier and operation is safer, since the risk of losing the identification plate is greatly reduced. In the prior art, however, if mounted incorrectly the identification plate can be pushed below a support web. Although cases such as this do not constitute correct mounting, the fitter may get this impression. In the event of shaking, a gust of wind or other external influences, the identification plate can get lost, and therefore the corresponding switch cabinet cannot always be clearly identified if, for example, there is no-one present who knows the function thereof. The invention helps to substantially avoid such incorrect mounting.

The carrier profile of the identification device has in particular an approximately U-shaped outer cross section. It is, however, also possible for the rear wall to extend out laterally beyond the holding walls in order, for example, to achieve a larger contact surface on a switch cabinet.

The support webs can also be termed supporting webs or receiving webs and are used to receive or support an identification plate received on the carrier profile.

It should be noted at this point that it may also be possible for two or more carrier profiles to be provided, which are used to receive a single identification plate. It is equally possible for two or more identification plates to be arranged on one carrier profile.

Preferably, at least one support web is connected to at least one holding wall. More preferably, one support web extends approximately parallel to the rear wall of the carrier profile.

The holding wall or walls are preferably arranged at the sides of the rear wall, so that the side walls or holding walls, together with the rear wall, form the in particular U-shaped outer cross section.

The rear wall can be formed as a continuous plate or can comprise a profile which also has through-openings.

More preferably, at least one misplacement guard is provided on at least one support web. The misplacement guard can comprise a web which extends from the support web towards the rear wall. The web of the misplacement guard can extend continuously over a part of the length or over the entire length of the carrier profile. It is also possible for the web to have a plurality of periodic recesses or breaks. Such a web can for example be comb-like. It is also possible for a plurality of webs to be provided.

Preferably, in the basic position a clearance remains between the end of the web of the misplacement guard and the rear wall. In the mounted position, the clearance between the end of the web and the rear wall can be smaller. It is also possible for the web to abut the rear wall when in the mounted position, so that there is no longer a clearance.

At least a portion of the support web can extend approximately parallel to the rear wall. In either the basic position or the mounted position, the web of the misplacement guard can extend approximately parallel to a holding wall. It is also possible, for example, for the web of the misplacement guard to extend transversely and in particularly approximately perpendicularly to the rear wall when in the mounted position.

It is preferable in all embodiments for at least one biasing and/or spring device to be provided in order to clamp the identification plate received on the carrier profile. In this development, in said mounted position the identification plate is biased in order to ensure that the identification plate fits securely on the carrier profile.

In particular, the biasing device is designed to bias an identification plate received in the mounted position into a position in which it is pushed away from the rear wall.

In advantageous embodiments, the biasing device has a spring portion on at least one support web. It is possible for the biasing device to be formed by a spring-loaded portion of the support web.

In preferred embodiments, at least one support web is elastically deformed in the mounted position. It is also possible for the web of the misplacement guard to be used as the spring unit or spring device and to be supported in a spring-loaded manner on the rear wall when in the mounted position. As a result, bias of the identification plate received on the support webs is achieved, and therefore said plate is securely received on the carrier profile. Even if the identification plate has slightly different dimensions (for example a thickness different from that intended), a reliable fit of the identification plate on the carrier profile is ensured.

It is possible for at least one holding wall to have a receiving groove for receiving the identification plate. In particular in conjunction with a biasing device, this leads to a secure fit of the identification plate on the carrier profile, even when the identification plate has different thicknesses.

A holding lug can be provided at a front end of the holding wall. When mounted, the holding lug encompasses the identification plate. The receiving groove can be formed by the holding lug and the support web.

In another embodiment, an identification device, according to the invention, for switch cabinets, other electrical devices and other systems has a carrier profile and at least one identification plate. The carrier profile is designed to receive the identification plate. The carrier profile has a rear wall and two lateral holding walls extending forwards from the rear wall. At least one support web is provided on the carrier profile and is suitable for supporting the identification plate. The support web extends transversely to at least one holding wall. In this case, at least one biasing device is provided, which is used to securely clamp the identification plate to the carrier profile.

This identification device according to an embodiment of the invention also has significant advantages, since it allows an identification plate to be rigidly and securely received on a carrier profile.

The biasing device can comprise at least one spring portion on at least one support web.

It is possible for the identification plate to be clamped between the support webs and holding lugs to the holding walls when in the mounted position.

Further embodiments of this identification device have some or all of the features of some or all of the aforementioned variants.

Figure 2:
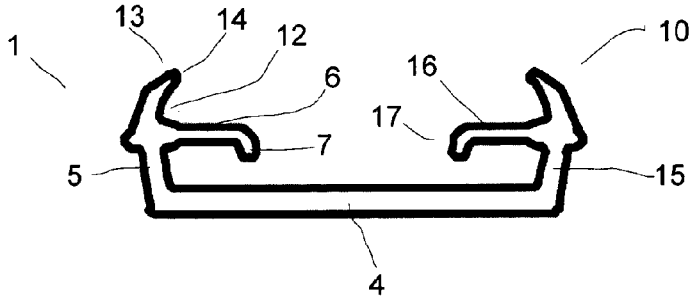
FIG. 2 is a section through the carrier profile according to FIG. 1.
Figure 3:
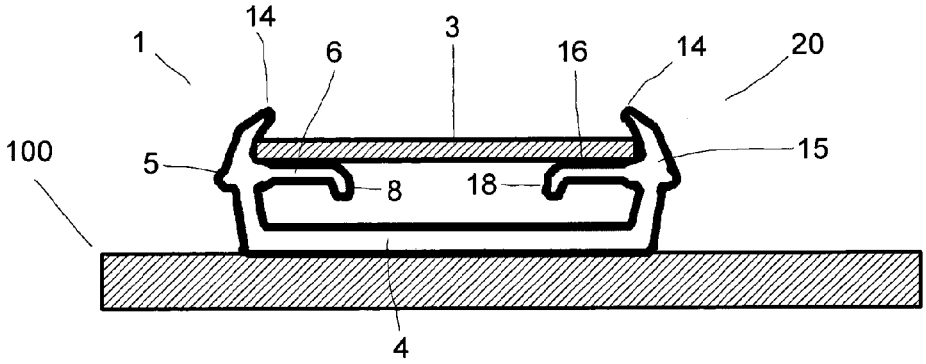
FIG. 3 shows an identification plate mounted on a switch cabinet.

With reference to the accompanying FIGS. 1 to 3, a first embodiment of an identification device according to the invention is described first of all. An identification device 1 according to an embodiment of the invention comprises a carrier profile 2 and at least one identification plate 3 (cf. FIG. 3).

An identification device 1 according to an embodiment of the invention is intended for switch cabinets 100, other electrical devices and other systems, and is fixed to a switch cabinet 100 by means of the carrier profile 2. Fixing can be carried out by means of bonding, screws, rivets or other fixing options.

The carrier profile 2 shown in a perspective view in FIG. 1 has a rear profile or a rear wall 4 and two holding walls 5 and 15 which are provided thereon at the sides. Altogether these create an approximately U-shaped outer cross section of the carrier profile 2.

To the holding wall 5 there is fixed a support web 6, which extends transversely therefrom. On the holding wall 15 there is provided a support web 16, which extends inwards transversely thereto. The support webs 6 and 16 form bearing surfaces for receiving an identification plate 3.

In principle it is also possible for the support webs 6 and 16 to not extend inwards from the lateral walls, but to be supported further inwards on the rear wall by means of separate carriers. For example, webs can extend upwards from the rear wall between the holding walls 5 and 15, on which webs the support webs 6 and 16 are arranged in a T-shape. In such a configuration, the support webs 6 and 16 are not fixed to the holding walls 5 and 15.

In this case, on each of the inner ends of the support webs 6, 16 a misplacement guard 7 or 17 is arranged. The misplacement guards 7 and 17 can be formed as webs 8, 18 which extend from the ends of the support webs 6 and 16 towards the rear wall 4. This ensures reliable placement since it is almost impossible to place an identification plate 3 below one of the support webs 6 or 16 (which would constitute incorrect mounting).

The front ends 13 of the holding walls 5 and 15 can each have a holding lug 14, which is used to fix an identification plate 3. In this case, a receiving groove 12 can be formed in each case between the support webs 6 and 16 and the front ends 13 having the holding lugs 14, said groove being used to receive the identification plate 3.

A second embodiment of the present invention will be explained with reference to FIGS. 4 to 9, like or similar components having like reference numerals.

Figure 4:
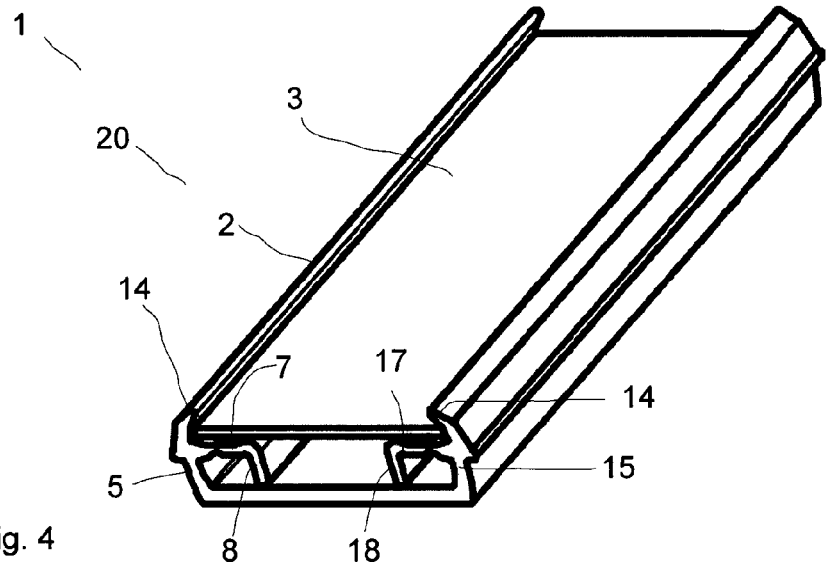
FIG. 4 shows another embodiment of a mounted identification plate.

FIG. 4 is a perspective view of the identification device 1, according to an embodiment of the invention, which is to be fixed to a switch cabinet 100, an identification plate 3 being received on the carrier profile 2. FIG. 4 shows the mounted position 20.

The carrier profile 2 again has a rear wall 4 and lateral holding walls 5 and 15, from each of which a support web 6 or 16 extends inwards. A misplacement guard 7 and 17 is provided on each support web 6 and 16 respectively. The misplacement guard 7 has a web 8 which extends from the support web 6 towards the rear wall 4. Accordingly, the misplacement guard 17 has a web 18 which projects from the support web 16 towards the rear wall 4.

In this embodiment, the webs 8, 18 are supported on the rear wall 4 in the mounted position 20 and form a part of the biasing devices 9 and 19 respectively. Each biasing device 9 or 19 acts as a spring device and loads the identification plate 3 such that said plate is received reliably and securely on the carrier profile 2.

Holding lugs 14 are provided on the front ends 13 of the holding walls 5 and 15, so that there are receiving grooves 12 on the holding walls 5 and 15, which grooves reliably and securely hold an identification plate 3, received thereon, on the carrier profile 2.

Figure 5:
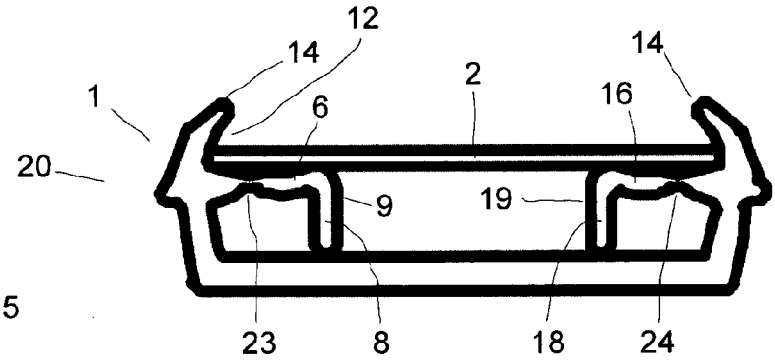
FIG. 5 is a cross section through the identification device according to FIG. 4.

FIG. 5 is a cross section through the identification device 1 according to FIG. 4. It is clear from this figure that the webs 8 and 18 of the misplacement guards 7 and 17 are supported on the rear wall 4 in the mounted position 20.

It is possible for resilient regions 23 and 24 to be provided on the support webs 6 and 16 respectively, which regions allow the support webs, having the webs 8 and 18 of the protection guards 7 and 17 provided thereon, to function in a resilient manner.

The identification plate 2 received on the identification device 1 is held by the holding lugs 14 and biased outwards, i.e. away from the rear wall 4, by the spring devices 9, 19, so that the identification plate 3 is under tension in the mounted position 20. This tension ensures that different thicknesses of the identification plate 3 can be compensated for and the identification plate 2 is received reliably and securely on the carrier profile 2 of the identification plate 3, even with slight dimensional differences.

Figure 6:
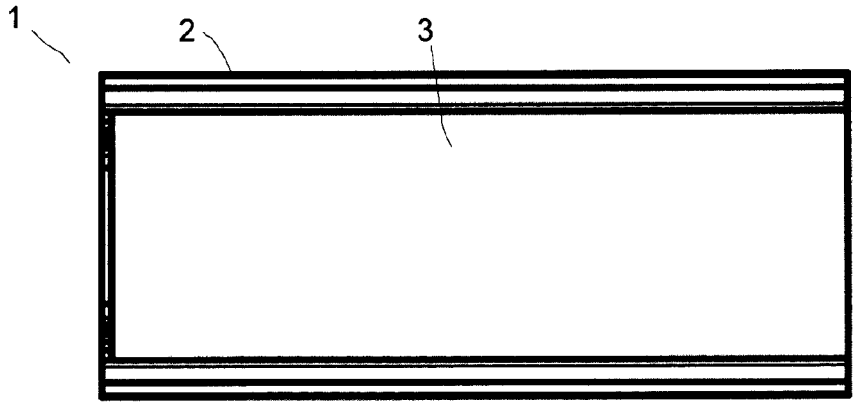
FIG. 6 is a plan view of the identification device according to FIG. 4.

FIG. 6 is a plan view of the identification device 1 having a mounted-on identification plate 3.

Figure 7:
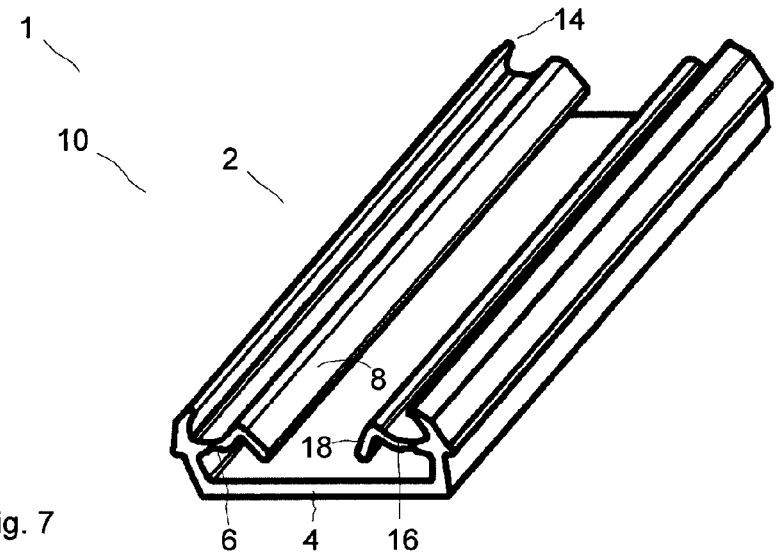
FIG. 7 is a perspective view of the carrier profile of the identification device according to FIG. 4.
Figure 8:
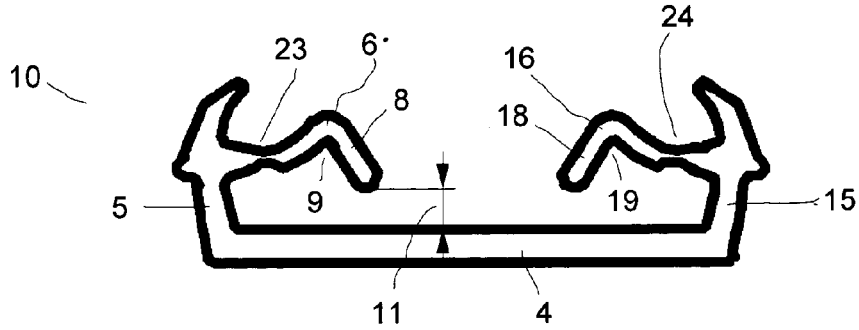
FIG. 8 is a cross section through the carrier profile according to FIG. 7.

FIG. 7 is a perspective view of the carrier profile 2 of the identification device 1 from FIG. 4. FIG. 7 shows the basic position 10, in which the biasing devices 9 and 19 are not biased. In the basic position 10, the support webs 6 and 16 are not oriented completely parallel to the rear wall 4, but rather form an outwardly facing spring portion, as is shown clearly in cross section in FIG. 8.

The spring portions and the biasing devices 9 and 19 extend outwards from the resilient regions 23 and 24 in order to allow an identification plate 3 to be received in a biased manner on the carrier profile.

The ends of the webs 8, 18 of the misplacement guards 7 and 17 have a clearance 11 from the rear wall 4. In this position too, the webs 8 and 18 reliably prevent incorrect mounting owing to the identification plate 3 being placed below the support webs 6 or 16. During mounting, the webs 8 and 18 and the support webs 6 and 16 are elastically deformed until the mounted position 20 shown in FIG. 5 is produced. In this position, there is no clearance between the ends of the webs 8 and 18 and the rear wall 4.

Figure 9:
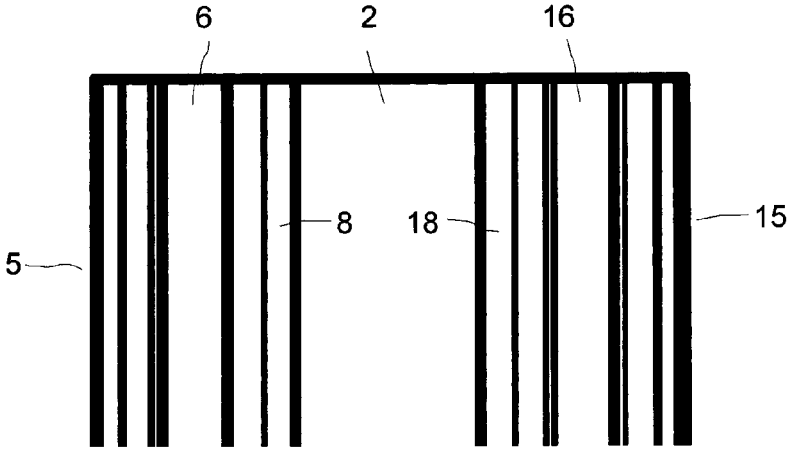
FIG. 9 is a plan view of a portion of the carrier profile according to FIG. 7.

FIG. 9 is a plan view of the carrier profile 2 according to FIG. 7. The support webs 6 and 16 extend inwards from the sides of the lateral holding walls 5 and 15. The webs 8 and 18 of the misplacement guard 7 and 17 respectively are arranged thereon.

Overall, the identification device according to an embodiment of the invention provides a reliable function that largely prevents incorrect mounting. Mounting is simplified at the same time. Placing an identification plate below the support webs 6 and 16 is reliably prevented. Regardless of the thickness of the identification plate 3 in each case, the biasing devices 9 and 19 bring about a secure fit on the carrier profile 2. The support surface for mounting the identification plates is enlarged and improved.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

Identification device 1
Carrier profile 2
Identification plate 3
Rear profile, rear wall 4
Holding wall 5
Support web 6
Misplacement guard 7
Web 8
Biasing device, spring device 9
Basic position 10
Clearance 11
Receiving groove 12
Front end 13
Holding lug 14

Holding wall 15
Support web 16
Misplacement guard 17
Web 18
Biasing device, spring device 19
Mounted position 20
Portion 21
Portion 22
Resilient region 23
Resilient region 24
Switch cabinets 100

What is claimed is:

1. An identification device for switch cabinets and other electrical devices, comprising:

at least one identification plate; and a carrier profile configured to receive the at least one identification plate, the carrier profile comprising:

a rear wall, a first and second lateral holding wall which extend forwards from the rear wall, and a support web configured to support the at least one identification plate when the at least one identification plate is received by the carrier profile, the support web extending transversely to at least one of the lateral holding walls and comprising:

a misplacement guard configured to prevent the identification plate from being placed below the support web when being mounted in the carrier profile, the misplacement guard having an elastically deformable misplacement guard web being configured to bias the at least one identification plate away from the rear wall, the elastically deformable misplacement guard web being displaced towards the rear wall when the at least one identification plate is received by the carrier profile.

2. The identification device recited in claim 1, wherein the support web is connected to at least one of the lateral holding walls.

3. The identification device recited in claim 1, wherein the elastically deformable misplacement guard web extends towards the rear wall.

4. The identification device recited in claim 1, wherein, when the at least one identification plate is not received by the carrier profile, a clearance remains between the end of the misplacement guard web and the rear wall and wherein, when the at least one identification plate is not received by the carrier profile, no substantial clearance remains between the end of the misplacement guard web and the rear wall.

5. The identification device recited in claim 1, wherein, at least a portion of the support web extends approximately parallel to the rear wall.

6. The identification device recited in claim 1, wherein the support web extends from the first holding wall towards the second holding wall.

7. The identification device recited in claim 1, wherein a biasing device is provided to clamp the at least one identification plate received on the carrier profile.

8. The identification device recited in claim 7, wherein when the at least one identification plate is received by the carrier profile, biasing device pushes away from the rear wall to bias the at least one identification plate.

9. The identification device recited in claim 7, wherein the biasing device comprises a spring portion on the at least one support web.

10. The identification device recited in claim 1, wherein at least one of the lateral holding walls has a receiving groove for receiving the at least one identification plate.

11. The identification device recited in claim 1, wherein a front end of at least one of the lateral holding walls has a holding lug.

12. An identification device for switch cabinets and other electrical devices, comprising:

at least one identification plate;

a carrier profile configured to receive the identification plate, the carrier profile comprising a rear wall, a first and second lateral holding wall which extend forwards from the rear wall, and a support web, the support web configured to bear the identification plate and extend transversely to at least one of the lateral holding walls; and an elastically deformable biasing device configured to securely clamp the identification plate to the carrier profile, wherein when the identification device is received by the carrier profile, the elastically deformable biasing device is displaced towards the rear wall.

13. The identification device recited in claim 12, wherein the elastically deformable biasing device comprises a spring portion on the support web.

14. The identification device recited in claim 13, further comprising another support web, and wherein when the identification plate is received by the carrier profile, the identification plate is clamped, between the support webs and a respective holding lug disposed at a front and of each holding wall, to the holding walls.

* * * * *